US008387802B2

(12) United States Patent
Barrett et al.

(10) Patent No.: US 8,387,802 B2
(45) Date of Patent: Mar. 5, 2013

(54) MOLDED END CAP FOR OILFIELD SCREENS

(75) Inventors: Robert M. Barrett, Walton, KY (US); Brian S. Carr, Burlington, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 12/958,905

(22) Filed: Dec. 2, 2010

(65) Prior Publication Data

US 2011/0186485 A1 Aug. 4, 2011

Related U.S. Application Data

(62) Division of application No. 11/174,875, filed on Jul. 5, 2005, now Pat. No. 7,866,482.

(51) Int. Cl.
*B07B 1/49* (2006.01)

(52) U.S. Cl. ..... 209/405; 209/399; 209/403

(58) Field of Classification Search ..... 209/385, 209/399, 403, 405
See application file for complete search history.

(56) References Cited

U.S. PATENT DOCUMENTS 3,900,628 A * 8/1975 Stewart ..... 428/134
5,769,241 A * 6/1998 Woodgate ..... 209/399
6,253,926 B1 7/2001 Woodgate
7,249,677 B2 * 7/2007 Cady et al. ..... 209/403
7,866,482 B2 1/2011 Barrett
2004/0007508 A1 * 1/2004 Schulte et al. ..... 209/403

OTHER PUBLICATIONS

Office Action issued in corresponding Mexican Patent Application No. MX/a/2008/000061; Dated Jan. 19, 2011 (2 pages).
Correspondence from Mexican attorney with English summary of Office Action issued Jan. 19, 2011; Mailed Feb. 11, 2011 (2 pages).
Official Action issued in corresponding Chinese Application No. 200680024831.6; Dated Jul. 31, 2012 (11 pages).
Office Action issued in corresponding Argentine Application No. P060102861 with English correspondence reporting the same; Dated Mar. 15, 2012 (3 pages).
Office Action issued in corresponding Chinese Application No. 200680024831.6; Dated Dec. 31, 2011 (7 pages).

* cited by examiner

*Primary Examiner* — Joseph C Rodriguez
*Assistant Examiner* — Kalyanavenkateshware Kumar
(74) *Attorney, Agent, or Firm* — Osha Liang LLP

(57) ABSTRACT

A filter screen to be used in conjunction with a shale shaker in removing solid matter from drilling fluids includes a filter plate having a plurality of perforations, a plurality of hold-down apertures, and a pair of end caps attached to the filter plate, wherein each end cap is configured to isolate the hold down apertures from the plurality of perforations.

5 Claims, 3 Drawing Sheets

MOLDED END CAP FOR OILFIELD SCREENS

CROSS-REFERENCE TO RELATED APPLICATIONS

This is a divisional application and claims benefit under 35 U.S.C. §120 of U.S. patent application Ser. No. 11/174,875, filed on Jul. 5, 2005 now U.S. Pat. No. 7,866,482.

FIELD OF THE INVENTION

The present invention generally relates to replacement filter screens for oilfield shale shakers. More particularly, the present invention relates to end caps for filter screens of oilfield shale shakers.

BACKGROUND OF THE INVENTION

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e. the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling mud are commonly referred to in the industry as "shale shakers." A shale shaker is a vibrating sieve-like table upon which returning dirty drilling mud is deposited and through which clean drilling mud emerges. Typically, the shale shaker is an angled table with a generally perforated filter screen bottom. Returning drilling mud is deposited at the top and as the drilling mud travels down the incline toward the lower end, the fluid falls through the perforations to a reservoir below leaving the solid particulate material behind. The combination of the angle of inclination with the vibrating action of the shale shaker table enables the solid particles left behind to flow until they fall off the lower end of the shaker table. Preferably, the amount of vibration and the angle of inclination of the shale shaker table are adjustable to accommodate various drilling mud flow rates and particulate percentages in the drilling mud. After the fluid passes through the perforated bottom of the shale shaker, it can either return to service in the borehole immediately, be stored for measurement and evaluation, or it may pass through an additional piece of equipment (e.g. a drying shaker, centrifuge, or a smaller sized shale shaker) to further remove smaller cuttings.

Because shale shakers are typically in continuous use, any repair operations and associated downtimes are to be minimized as much as possible. Often, the filter screens of shale shakers, through which the solids are separated from the drilling mud, wear out over time and need replacement. Therefore, shale shaker filter screens are typically constructed to be quickly and easily removed and replaced. Generally, through the loosening of only a few bolts, the filter screen can be lifted out of the shaker assembly and replaced within a matter of minutes. While there are numerous styles and sizes of filter screens, they generally follow the same design. Typically, filter screens comprise a perforated plate base upon which a wire mesh, or other perforated filter overlay, is positioned. The perforated plate base generally provides structural support and allows the passage of fluids therethrough while the wire mesh overlay defines the largest solid particle capable of passing therethrough. While many perforated plate bases are generally flat or slightly curved in shape, it should be understood that perforated plate bases having a plurality of corrugated, or pyramid-shaped channels extending thereacross may be used instead. In theory, the pyramid-shaped channels provide additional surface area for the fluid-solid separation process to take place and act to guide solids along their length toward the end of the shale shaker where they are disposed of.

A typical shale shaker filter screen includes a plurality of hold-down apertures at opposite ends of the filter screen. These apertures, preferably located at the ends of the filter screen that will abut walls of the shale shaker, allow hold down retainers of the shale shaker to grip and secure the filter screens in place. However, because of their proximity to the working surface of the filter screen, the hold-down apertures must be covered to prevent solids in the returning drilling fluid from bypassing the filter mesh through the hold-down apertures. To prevent such bypass, an end cap assembly is placed over each end of the filter screen to cover the hold-down apertures. Presently, these caps are constructed by extending a metal cover over the hold down apertures and attaching a wiper seal thereto to contact an adjacent wall of the shale shaker. Furthermore, epoxy plugs are set in each end of the end cap to prevent fluids from communicating with the hold-down apertures through the sides of the end cap.

While current filter screen end caps are effective, they are complex structures that take considerable time and expense to fabricate. A less expensive and complicated end cap would be well received in the industry.

BRIEF SUMMARY OF THE INVENTION

According to one aspect of the present invention, a filter screen configured to be used with a shale shaker includes a filter plate having a plurality of perforations arrayed between a first end and a second end, wherein the plurality of perforations is configured to substantially prevent particles larger than a designated mesh size from passing through the filter plate. The filter screen also includes a plurality of hold-down apertures on the filter plate adjacent to the first end and the second end, wherein the hold-down apertures are configured to allow corresponding hold-down retainers of the shale shaker to be engaged therethrough to hold the filter plate in place. The filter screen also includes a pair of molded end caps attached to the filter plate at the first and second ends, wherein each molded end cap is configured to cover and isolate the hold-down apertures from the plurality of perforations.

According to another aspect of the present invention, a filter screen configured to be used with a shale shaker includes a filter plate having a plurality of perforations arrayed between a first end and a second end, wherein the plurality of perforations is configured to substantially prevent particles larger than a designated mesh size from passing through the filter plate. The filter screen also includes a plurality of hold-down apertures on the filter plate adjacent to the first end, wherein the hold-down apertures are configured to allow corresponding hold-down retainers of the shale shaker to be engaged therethrough to hold the filter plate in place. The filter screen also includes a molded end cap attached to the filter plate at the first end, wherein molded end cap is configured to cover and isolate the hold-down apertures from the plurality of perforations. The filter screen also includes a wiper integrated into the molded end cap, wherein the wiper is configured to contact an internal surface of the shale shaker to prevent drilling fluids from bypassing the filter plate.

According to another aspect of the present invention, an end cap to be used in conjunction with a filter screen for a shale shaker includes a bottom surface configured to be attached to a mounting end of the filter screen. The end cap also includes a back surface configured to abut an internal surface of the shale shaker, wherein an integrated wiper extends upward and away from the back surface to contact the internal surface of the shale shaker to prevent drilling fluids from bypassing the filter screen. The end cap also includes a longitudinal cap surface extending from a leading edge of the bottom surface to the back surface adjacent the integrated wiper, wherein the cap surface is configured to prevent drilling fluids from communicating with the hold-down apertures. The end cap also includes two end surfaces, each connecting the bottom, back, and longitudinal cap surfaces, on opposite ends of the end cap, wherein the bottom, back, longitudinal cap, and two end surfaces are constructed as a molded single component.

According to another aspect of the present invention, a filter screen configured to be used in conjunction with a shale shaker to remove solid matter from drilling fluids includes a filter plate having a plurality of perforations arrayed between a first end and a second end, wherein the filter plate includes approximately 90 degree upward bends proximal to each of the first and second ends. The filter screen also includes a plurality of hold-down apertures located on the filter plate between the plurality of perforations and the approximately 90 degree bends at each of the first and second ends. The filter screen also includes a pair of end covers, each extending from a location on the filter plate proximal to the plurality of perforations to a location above the approximately 90 degree bends, and over the hold-down apertures at the first and second ends. The filter screen also includes four replaceable end plugs, each configured to be inserted into sockets created by intersections of the filter plate, the approximately 90 degree bends, and the end caps, wherein the molded end plugs are configured to isolate the hold-down apertures from the plurality of perforations.

Other aspects and advantages of the invention will be apparent from the following description and the appended claims.

DETAILED DESCRIPTION OF THE INVENTION

Figure 1:
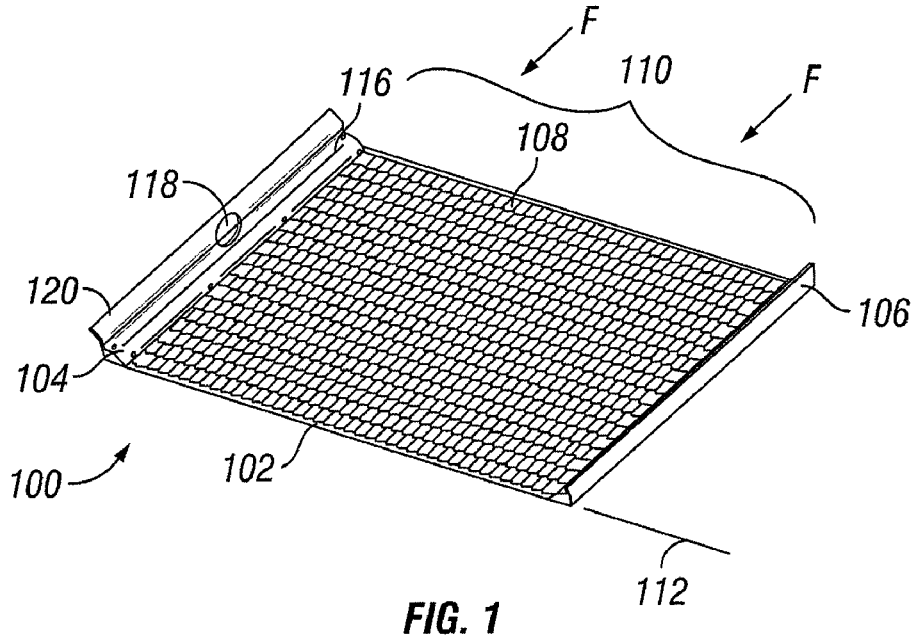
FIG. 1 is an isometric view drawing of a shale shaker filter screen assembly in accordance with an embodiment of the present invention.

Referring initially to FIG. 1, a filter screen 100 for an oilfield shale shaker in accordance with a first embodiment of the present invention is shown. Filter screen 100 is shown as having a filter plate 102 extending between a first end 104 and a second end 106. A plurality of perforations 108 is arrayed 110 between first end 104 and second end 106. A fine mesh screen (not visible) covers perforations 108, 110 such that solid particles larger than a designated mesh size in a slurry flowing across filter screen 100 will not pass through. In operation, filter screen 100 is installed into a shale shaker (not shown) and drilling mud returning from the borehole is washed across filter screen 100 in a flow direction F such that the drilling fluid passes through the mesh covering apertures 108, 110 and the solids are separated out. Preferably, the shale shaker is inclined such that the solids left behind upon filter screen 100 continue to "flow" along the screen surface until they fall off an edge 112 of filter plate 102 into a hopper, conveyor belt, or other collection means.

Figure 2A:
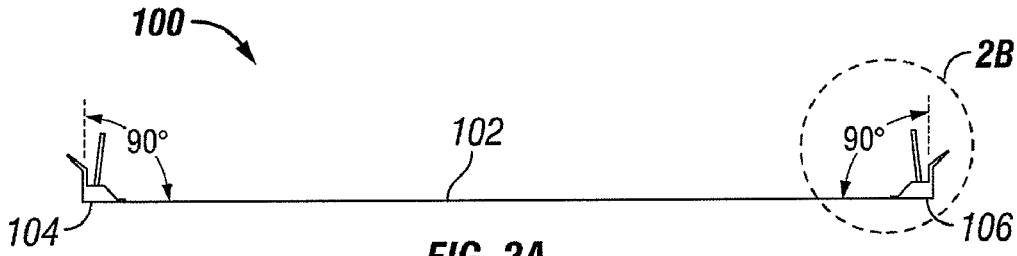
FIG. 2 is an side view drawing of an end cap for the shale shaker filter screen assembly of FIG. 1.
Figure 2B:
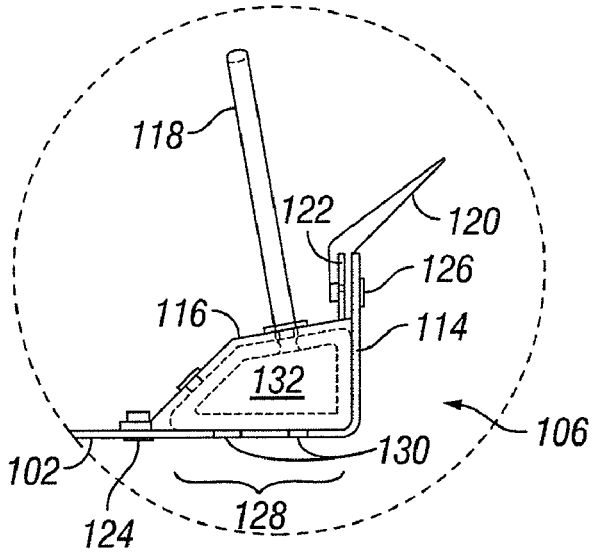

Referring now to FIG. 2, a close up side view of second end 106 of filter screen 100 is shown. While first end 104 of filter screen 100 is not shown in detail, it should be understood that first end 104 can contain substantially the same components as found in second end 106. While it may be possible for first end 104 and second end 106 to differ in structure and composition, it should be understood that most shale shakers in production and use today are arranged such that both ends 104, 106 of filter screens 100 are identical to enable installation and removal from either side of the machine.

Nonetheless, second end 106 details the construction of an end of a filter screen 100 in accordance with an embodiment of the present invention. Particularly, at second end 106, filter plate 102 is bent at a substantially 90 degree angle to form a bend section 114 that extends up from the filter plate 102 a few inches. While filter plate 102 and bend section 114 are suggested to be constructed from a malleable metallic material, it should be understood that non-deformable materials can be used. Particularly, composite or polymeric materials can be used for filter plate 102 and constructed with bend sections 114 molded or cast in place.

Next, a longitudinal end cover 116 extends from filter plate 102 to an upper portion of bend section 114. Preferably, longitudinal end cover 116 begins at filter plate 102 as near as possible to the array 110 of perforations 108 without covering perforations 108. The path of longitudinal end cover 116 follows a generally hypotenuse-like pathway from filter plate 102 to bend section 114, but may form one or more bends along the way. Optionally, a handle 118 can be attached to longitudinal end cover 116 to facilitate lifting and placement of filter screen 100 within the shale shaker.

A wiper 120, generally located at the intersection of longitudinal end cover 116 and bend section 114, extends up and away from filter plate 102 as shown. Wiper 120 is preferably constructed from a pliable material appropriate for seal use (e.g. nitrile) and is shown compressed between bend section 114 and a backing plate 122. While backing plate 122 is shown as a separate component, it should be understood that backing plate 122 can be constructed as a bent section of longitudinal end cover 116. Wiper 120 functions to contact an inside wall of the shale shaker adjacent installed filter screen 100 such that no fluid materials can bypass filter screen 100 and go behind bend section 114.

Fasteners 124, 126, holding filter plate 102, longitudinal end cover 116, backing plate 122, and bend section 114 in place, work in conjunction with wiper 120 to create an isolated region 128 of filter plate 102 between longitudinal end cover 116 and bend section 114 that is isolated from fluids flowing across filter screen 100. A plurality of hold-down apertures 130 are typically located inside of region 128 on filter plate 102 and are configured to allow hold down retainers (not shown) of a shale shaker to grip and retain filter screen 100 in place during use. While the specific geometry and dimension of hold-down apertures 130 will vary depending on the style and type of shale shaker used, it should be understood that anything located within region 128 of filter screen 100 will be isolated from fluid flowing across array 110 of perforations 108.

Figure 3:
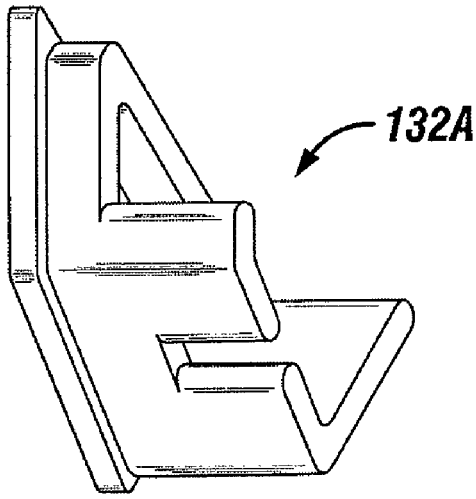
FIG. 3 is an isometric view of a first end plug for the shale shaker filter screen assembly of FIG. 1.
Figure 4:
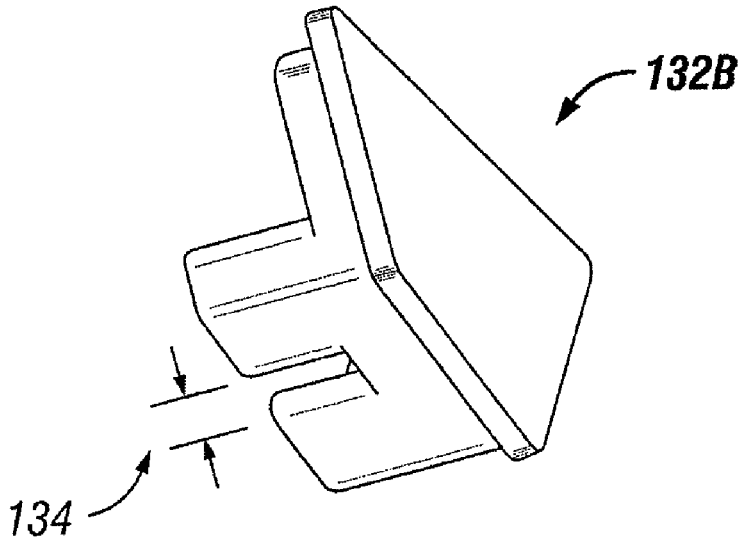
FIG. 4 is an isometric view of a second end plug for the shale shaker filter screen assembly of FIG. 1.

Finally, an end plug 132 is inserted within the socket opening created by the edges of filter plate 102, bend section 114, and longitudinal end cover 116. End plugs 132 (shown in more detail in FIGS. 3 and 4) are preferably constructed from injection molded urethane, but any material or manufacturing method known to one of skill in the art may be employed. Referring briefly to FIG. 3, a first end plug 132A is shown. First end plug 132A is of the type and geometry that would be insertable within the socket opening shown on second end 106 of FIG. 2. Second end Plug 132B (shown in FIG. 4) is a corresponding "mirror" image of plug 132A appropriate for engagement within first end 104, or within the opposite side (not shown) of second end 106. Nonetheless, end plugs 132A, 132B are configured to be inserted within socket openings formed by filter plate 102, bend section 114, and longitudinal end cover 116 at ends 104, 106. As such, end plugs 132A, 132B prevent the drilling fluids from coming into contact with hold-down apertures 130 within region 128 from the end of filter screen 100. End plugs 132A, 132B can be constructed to be held in place through interference fit with surrounding components or may be fastened in place with rivets, bolts, screws, pins, or any other fastener known in the art. Optionally, a fastener groove 134 (identified in FIG. 4) may be located within end plug 132 to enable a fastener to grip and retain end plug 132 in place. Optionally still, a hydraulic seal (not shown) may be positioned around the periphery of end plug 132A, 132B to act as an additional barrier to fluid invasion. If installed, the hydraulic seal can be of flat gasket or round o-ring type. Alternatively, a liquid or gel-type adhesive or gasket compound may be applied to end plug 132A, 132B such that once hardened or cured, the compound serves as a hydraulic seal.

Figure 5:
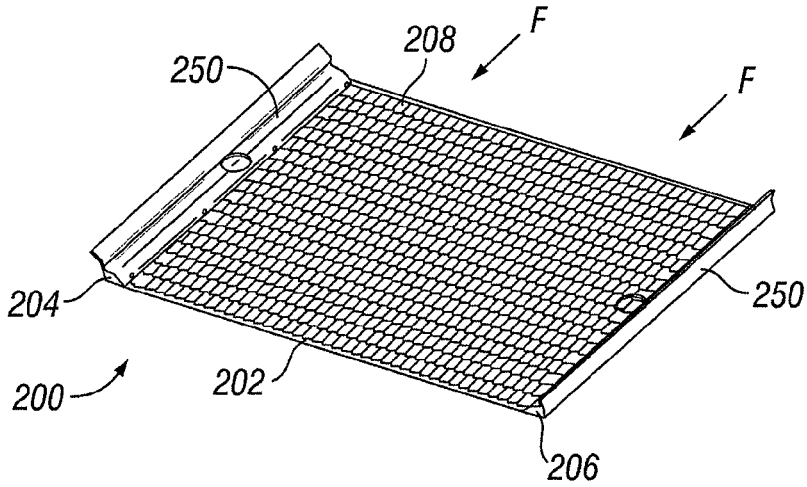
FIG. 5 is a side view drawing of a shale shaker filter screen assembly in accordance with an alternative embodiment of the present invention.
Figure 6:
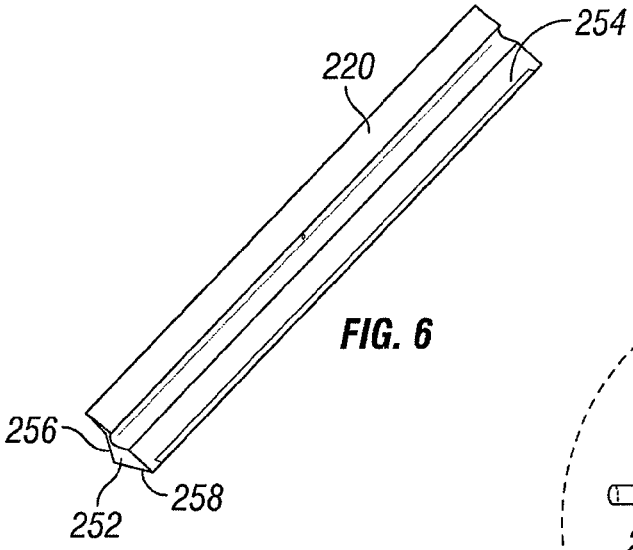
FIG. 6 is an isometric view drawing of an end cap for the shale shaker filter screen assembly of FIG. 5.

Referring now to FIG. 5, a filter screen 200 for an oilfield shale shaker in accordance with a second embodiment of the present invention is shown. Similar to filter screen 100 of FIGS. 1 and 2, filter screen 200 of FIG. 5 includes filter plate 202, a first end 204, a second end 206, and a plurality of apertures 208 therebetween. Filter screen 200 differs from filter screen 100 in that a single molded end cap 250 is used to cover hold-down apertures 230 (shown in FIG. 7) on each end 204, 206 rather than a plurality of components. Referring to FIG. 6, the molded end cap 250 is shown as a single molded component having end surfaces 252, a longitudinal cap surface 254, a back surface 256, and a bottom surface 258. An integral wiper 220 extends up and away from back surface 256.

Figure 7:
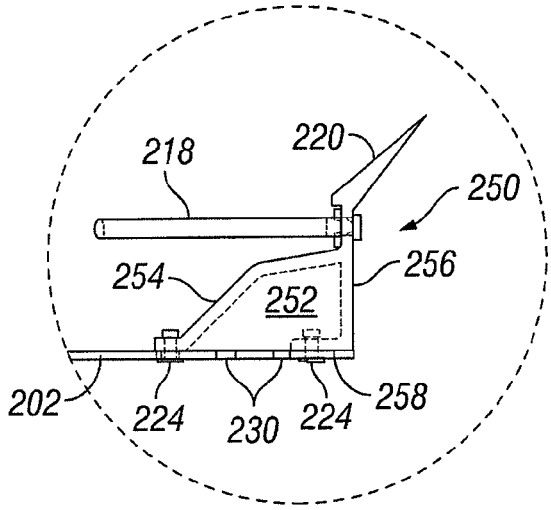
FIG. 7 is an isometric view drawing of the end cap of FIG. 6.

Referring to FIG. 7, the molded end cap 250 is shown in more detail. End cap 250 is shown constructed as a single, unitary, injection-molded part, preferably of a polymeric or elastomeric material. While a single, unitary injection molded polymeric component is shown, it should be understood that end cap 250 can be constructed from any number of materials known in the art. In FIG. 7, end cap 250 is shown attached at its bottom surface 258 to the top of filter plate 202 by a plurality of fasteners 224. Fasteners 224 are shown as rivets, but can be screws, bolts, pins, or any other fastener known in the art. With end cap 250 secured in place by fasteners 224, drilling fluid crossing filter screen 200 (in direction F) will not communicate with hold-down apertures 230 hidden underneath.

As with filter screen 100 of FIGS. 1 and 2, wiper 220 prevents fluid from bypassing filter screen assembly 200. However, unlike wiper 120 of FIGS. 1 and 2, wiper 220 of FIGS. 5-7 is molded with the rest of molded end cap 250 and is not mechanically attached. Therefore, it is preferred, although not required, that molded end cap 250 be constructed of a material (with corresponding durometer hardness) pliable enough to be an appropriate choice for wiper 220. Alternatively, molded end cap 250 can be constructed as a binary component, whereby a first material with a relatively soft durometer (e.g. nitrile) is molded for wiper 220 and a second material of a relatively hard durometer (e.g. urethane) is molded for remaining surfaces 252, 254, 256, and 258. Alternatively still, a single material for molded end cap 250 can be selected whereby the durometer hardness is variable, whereby wiper 220 is softer than the remainder of end cap 250. Such a composition can be the product of softening additives in wiper 220 section or varying thermal treatments for end cap 250. Whatever the material composition, molded end cap 250 effectively covers hold-down apertures 230 and engages an inner surface of shale shaker with wiper 220.

Advantageously, because molded end cap 250 includes its own back surface 256, a 90 degree bend in the filter plate 202 similar to that (114) of the filter plate 102 of FIGS. 1 and 2 is no longer necessary. As such, filter screens 200 manufactured for use with end caps 250 can be manufactured with less complexity and material than formerly possible. Furthermore, as molded end cap 250 spans the entire width of second end 206 of filter screen 200, one design for molded end cap 250 is adaptable for use either on first end 204 or second end 206 of filter screen 200. In contrast, end plugs 132 of FIGS. 1-4 must be manufactured in two styles, one for each end of longitudinal end cover 116. Using molded end cap 250 enables a manufacturer of filter screens 200 to stock a single part (250) rather than two separate parts (132A, 132B). Optionally, a lifting and positioning handle 218 may be fastened directly to end cap 250 to allow filter screen 200 to easily be lifted and repositioned within the shale shaker.

Furthermore, while filter screens 100, 200 disclosed in the present application are all of the flat plate variety, it should be understood that end plugs 132 and molded caps 250 of the present invention are similarly useful in conjunction with corrugated or pyramid-shaped filter screens. Corrugated and pyramid-shaped filter screens differ from their flat plate siblings in that their filter plates (102, 202) are not continuous flat plates, but instead comprise a plurality of longitudinal pyramid-shaped channels through which the drilling mud flows. Pyramid-shape screens have the advantage of increasing the amount of filtration area exposed to the flowing mud and help direct the solids removed to the disposal end of the filter screen. Therefore, the shape, design, and construction of the filter plate 102, 202 spanning the distance between first ends (104, 204) and second ends (106, 206) of filter screens 100, 200 is of little consequence as long as hold-down apertures 130, 230 are isolated from the flowing drilling mud.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An end cap to be used in conjunction with a filter screen for a shale shaker, the end cap comprising:

a bottom surface configured to be attached to a mounting end of the filter screen;

a back surface configured to abut an internal surface of the shale shaker, wherein an integrated wiper extends upward and away from the back surface to contact the internal surface of the shale shaker to prevent drilling fluids from bypassing the filter screen;

a longitudinal cap surface extending from a leading edge of the bottom surface to the back surface adjacent the integrated wiper, wherein the cap surface is configured to prevent drilling fluids from communicating with a plurality of hold-down apertures; and two end surfaces, each connecting the bottom, back, and longitudinal cap surfaces, on opposite ends of the end cap;

wherein the bottom, back, longitudinal cap, and two end surfaces are constructed as a molded single component.

2. The end cap of claim 1, wherein the bottom surface surrounds hold-down apertures of the filter screen.

3. The end cap of claim 1, wherein the molded single component is manufactured of urethane.

4. The end cap of claim 1, wherein the single molded component is manufactured of varying durometer hardness.

5. The end cap of claim 4, wherein the integrated wiper has a lower durometer hardness than the bottom, back, longitudinal, and two end surfaces.

* * * * *